US012751518B2

(12) United States Patent
Dallas

(10) Patent No.: US 12,751,518 B2
(45) Date of Patent: Oct. 6, 2026

(54) DURABLE MOC-TOE CONSTRUCTION

(71) Applicant: RED WING SHOE COMPANY, INC., Red Wing, MN (US)

(72) Inventor: Jason Dallas, Ellsworth, WI (US)

(73) Assignee: RED WING SHOE COMPANY, INC., Red Wing, MN (US)

( * ) Notice: Subject to any disclaimer, the term of this patent is extended or adjusted under 35 U.S.C. 154(b) by 0 days.

(21) Appl. No.: 18/984,396

(22) Filed: Dec. 17, 2024

(65) Prior Publication Data

US 2025/0194731 A1 Jun. 19, 2025

Related U.S. Application Data

(60) Provisional application No. 63/612,081, filed on Dec. 19, 2023.

(51) Int. Cl.

| | |
|---|---|
| ***A43B 3/14*** | (2006.01) |
| ***A43B 1/00*** | (2006.01) |
| ***A43B 23/02*** | (2006.01) |

(52) U.S. Cl.

CPC ..... *A43B 3/14* (2013.01); *A43B 1/0027* (2013.01); *A43B 23/021* (2013.01);

(Continued)

(58) Field of Classification Search

CPC ..... A43B 3/14; A43B 23/021; A43B 23/025; A43B 23/0215; A43B 23/0295; A43B 9/02; A43B 9/06

See application file for complete search history.

(56) References Cited

U.S. PATENT DOCUMENTS 1,231,183 A * 6/1917 Merrill ..... A43B 3/14 12/142 MC
2,306,937 A * 12/1942 Diller ..... A43B 23/0215 264/225

(Continued)

FOREIGN PATENT DOCUMENTS

| | | |
|---|---|---|
| CA | 2460932 | 9/2004 |
| EP | 0308373 | 3/1989 |

(Continued)

OTHER PUBLICATIONS

Terra, "Men's Terra Ironstone 8" Waterproof Compsite Toe Safety Work Boot," available as early as Aug. 4, 2023 at: https://www.terrafootwear.com/mens-terra-ironstone-8%22-waterproof-composite-toe-safety-work-boot/195968045481.html?srsltid=AfmBOor9vLREI6-ASBVOALSjitxS5UAKXiioK6lrwfEZO_jUCL4eO37V.

(Continued)

*Primary Examiner* — Ted Kavanaugh
(74) *Attorney, Agent, or Firm* — Merchant & Gould P.C.

(57) ABSTRACT

The present disclosure provides a moc-toe style boot comprising a sole and an upper, the upper including a foot covering portion connected to the sole and a lower leg covering portion located above the foot covering portion, wherein the foot covering portion includes a toe covering portion, a heel covering portion, and an instep covering portion. The foot covering portion defines at least a portion having a one-piece molded polymeric construction, wherein the one-piece molded polymeric construction defines a vertical toe wall of the toe covering portion and an upper vamp of the instep covering portion that extends to at least the eyestays defined by the upper of the boot.

7 Claims, 7 Drawing Sheets

(52) U.S. Cl.
CPC ..... *A43B 23/0215* (2013.01); *A43B 23/025* (2013.01); *A43B 23/0295* (2013.01)

(56) References Cited

U.S. PATENT DOCUMENTS

| | | | | |
|---|---|---|---|---|
| 2,578,987 | A | 12/1951 | Schultz | |
| 2,694,870 | A | 11/1954 | Meltzer | |
| 2,904,838 | A * | 9/1959 | Phillips, Jr. | B29D 35/126 264/226 |
| 3,034,235 | A | 5/1962 | Hunting et al. | |
| 3,319,361 | A * | 5/1967 | Bernier | A43B 23/0245 36/11 |
| 3,530,597 | A | 9/1970 | Batchelder et al. | |
| 3,605,294 | A * | 9/1971 | Cunningham | A43B 23/0255 12/146 C |
| 3,685,071 | A * | 8/1972 | Dicks | B29C 41/006 12/146 C |
| 3,972,136 | A | 8/1976 | Epstein | |
| 5,111,597 | A | 5/1992 | Hansen et al. | |
| 5,210,963 | A | 5/1993 | Harwood | |
| D389,989 | S | 2/1998 | Pilz | |
| 5,725,823 | A * | 3/1998 | Finn | B29D 35/142 36/31 |
| D500,399 | S | 1/2005 | Fuerst | |
| 6,907,681 | B2 | 6/2005 | Tanaka et al. | |
| 7,421,807 | B2 | 9/2008 | Condie | |
| 7,631,440 | B2 | 12/2009 | Keen et al. | |
| D668,030 | S | 10/2012 | Youngs | |
| D683,115 | S | 5/2013 | Sander | |
| 8,533,976 | B2 | 9/2013 | Fuerst | |
| D701,024 | S | 3/2014 | Youngs et al. | |
| 10,786,044 | B2 | 9/2020 | Burch | |
| 10,849,385 | B2 | 12/2020 | Ludemann et al. | |
| D1,020,189 | S | 4/2024 | Girouard | |
| 2005/0022426 | A1 | 2/2005 | Clark et al. | |
| 2012/0167419 | A1 | 7/2012 | Park et al. | |
| 2015/0335101 | A1 | 11/2015 | Monroy et al. | |
| 2021/0204637 | A1 * | 7/2021 | Deepesh | A43B 1/0054 |
| 2023/0389646 | A1 * | 12/2023 | Swigart | A43B 7/143 |

FOREIGN PATENT DOCUMENTS

| | | | | |
|---|---|---|---|---|
| GB | 2170445 A * | 8/1986 | | B32B 9/04 |
| JP | 2003265201 | 9/2003 | | |
| WO | 2007143228 | 12/2007 | | |

OTHER PUBLICATIONS

Ariat, "Sump Jumper 8" CSA Glacier Grip Waterproof 600g Composite Toe Work Boot, available as early as Aug. 4, 2023 at: https://www.ariat.com/P22054_M_FOO.html?dwvar_P22054_M_FOO_color=IRON_COFFEE&dwvar_P22054_M_FOO_width=D_Medium.

Brunt Workwear, "Brunt Launches Patent-pending Brunt Toe Putting Customer Needs First," Feb. 9, 2023.

CAT Footwear, Men's Excavator Superlite Waterproof Carbon Composite Toe Work Boot, available as early as Aug. 4, 2023 at: https://www.catfootwear.com/US/en/excavator-xl-6-inch-waterproof-composite-toe-work- boot/884547744326.html.

Keen, "Men's Camden 6" Waterproof Boot (Carbon Toe)," available as early as Aug. 4, 2023 at: https://www.keenfootwear.com/collections/mens-work/products/mens-camden-6-waterproof-leather-brown-black.

Thorogood, "Infinity FD Series—8" Stud Horse Insulated Waterproof Safety Toe Boot," available as early as Aug. 4, 2023 at: https://thorogoodusa.com/infinity-8-studhorse-waterproof-400g-safety-toe-804-4304/.

Thorogood, "GEN-FLEX2 Series—6" Brown Composite Safety Cap Toe," available as early as Aug. 4, 2023 at: https://thorogoodusa.com/genflex2-6-brown-non-metallic-safety-toe-804-4445/.

Timberland, "Men's Heritage Hyperion 6" Composite Toe Waterproof Work Boot," available as early as Aug. 4, 2023 at: https://www.timberland.com/en-us/p/timberland-pro/mens-footwear-10171/mens-timberland--pro-hyperion-6-waterproof-xl-comp-toe-work-boot-TB0A5N4J214.

Timberland, Women's Boondock CSA 8" Composite Toe Waterproof Insulated Work Book, available as early as Aug. 4, 2023 at: https://www.timberland.com/en-us/p/timberland-pro/best-sellers/new-arrivals-46001/womens-timberland-pro-boondock-8-waterproof-comp-toe-work-boot-TB0A5R7K001.

Wolverine, "Hellcat Fuse Durashocks Ultraspring 6" Caronmax Work Boot," available as early as Aug. 4, 2023 at: https://www.wolverine.com/US/en/hellcat-ultraspring-heavy-duty-6-inch-carbonmax-work-boot/52261M.html?dwvar_52261M_color=W211135#cgid=men-footwear-work-safety-toe&start=1.

* cited by examiner

DURABLE MOC-TOE CONSTRUCTION

CROSS-REFERENCE TO RELATED APPLICATION

This application claims the benefit of U.S. Provisional Application Ser. No. 63/612,081, filed Dec. 19, 2023, the disclosure of which is hereby incorporated by reference in its entirety.

TECHNICAL FIELD

Moccasin-toe type boots with improved durability.

BACKGROUND

A moc-toe boot generally and commonly refers to a type of leather work boot with a "U" shaped stitched toe box. The "U" shaped stitched toe box provides increased comfort, extra flexibility, and toe protection while working. The term "moc" is short for the term "moccasin". The shape of the moc-toe, with the higher walls in the toe box, offers more room for the wearer's toes, offering extra comfort. Moc-toe boots are primarily associated with work boots designed for rugged performance. However, the classic looks make moc-toe boots a good choice for wearing both on the job and out on the town.

In most of the moc-toe type boot designs in the market, the seam on the top of the toe box is created by stitching together two pieces of material (e.g., leather) around the toe box. Although this construction gives the moc-toe boot its classic looks and provides added flexibility, the stitched seam around the toe box and also the toe box in general can be a problem area for these types of boots. The stitched seam is generally a weak spot for moc-toe type boots, where the upper can start to separate from the lower toe wall due to heavy use. And, for certain types of moc-toe type boots that have an internal rigid toe protector (i.e., safety toe protector), a hard object such as the toe protector beneath the moc-toe area does not allow a lot of give or forgiveness, leading to possible tearing or blow-out of the exterior of the toe area.

Improvements in construction of moc-toe boots are desired.

SUMMARY

The present disclosure provides a moc-toe style boot that includes a one-piece molded/pre-molded (e.g., polymeric) structure forming at least a portion of the toe box construction. According to certain examples, the molded piece may be formed from polymers such as thermoplastic polyurethane (TPU) or other similar materials. The one-piece molded structure is designed to form both the lower toe wall and the upper vamp portion of the toe box of the boot. According to the depicted example, the pre-molded structure provides a one-piece design, where the toe wall and the upper vamp are all molded as a single piece and where the upper portion of the molded piece extends all the way back past the eyestays (e.g., leather) of the boot.

According to certain embodiments, the pre-molded polymeric structure is designed to resemble the material of the upper of the boot. For example, when the upper of the boot is of organic leather construction, the pre-molded structure is designed to resemble such leather construction. The pre-molded structure may also be provided with stitching designed to resemble the way leather pieces would be stitched in forming the seam of the toe box of conventional moc-toe boots.

The one-piece molded polymeric structure greatly improves the durability of the area that is commonly associated with the stitched seam, while preserving the classic looks of the "U" shaped stitched toe box.

According to one example aspect, the present disclosure provides a moc-toe style boot comprising a sole and an upper, the upper including a foot covering portion connected to the sole and a lower leg covering portion located above the foot covering portion, wherein the foot covering portion includes a toe covering portion, a heel covering portion, and an instep covering portion. The foot covering portion defines at least a portion having a one-piece molded polymeric construction, wherein the one-piece molded polymeric construction defines a vertical toe wall of the toe covering portion and an upper vamp of the instep covering portion that extends to at least the eyestays defined by the upper of the boot.

DETAILED DESCRIPTION

Figure 1:
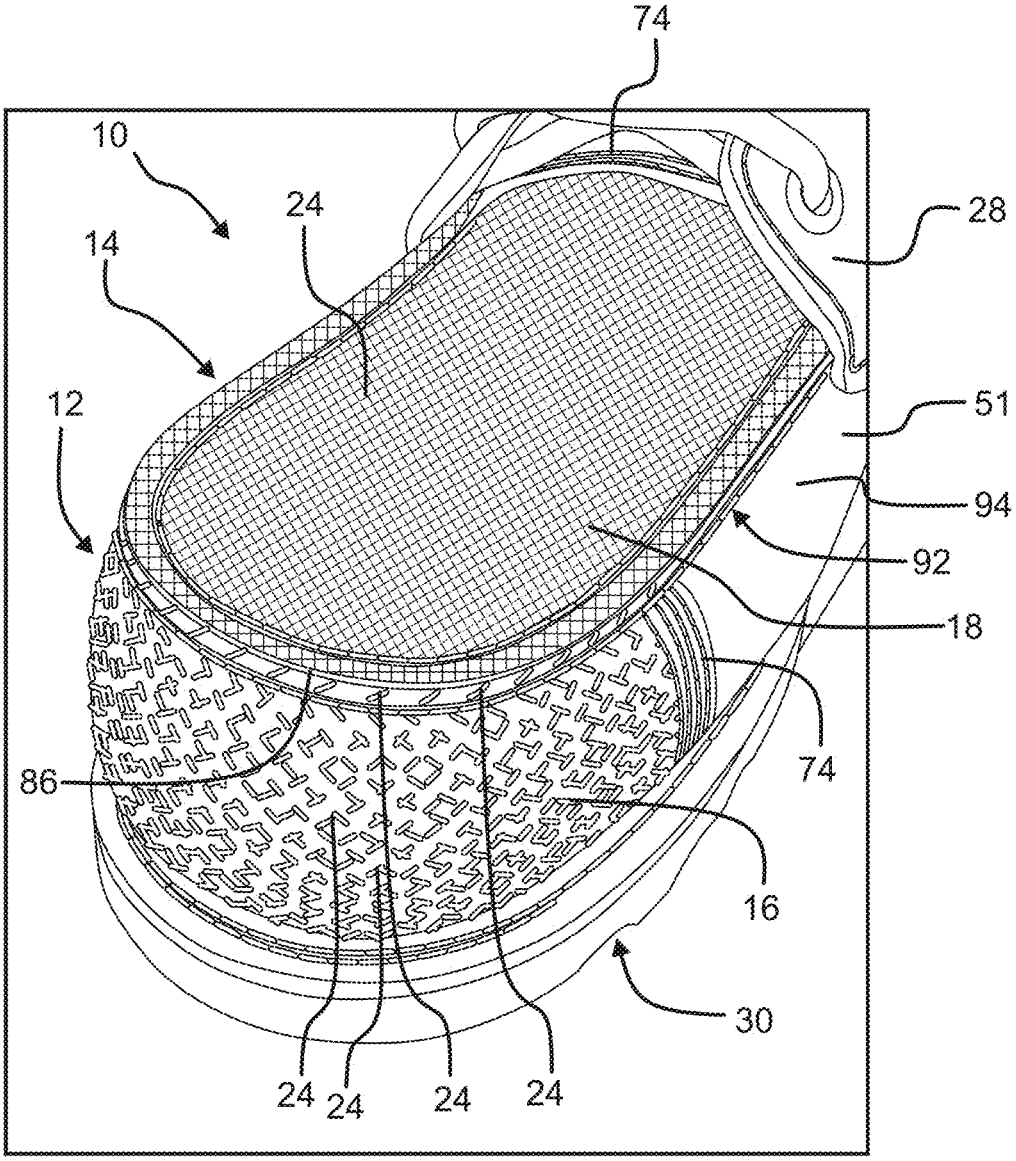
FIG. 1 is a partial front perspective view of a boot including the inventive durable moc-toe construction according to the principles of the present disclosure.

Referring to the FIGS. 1-9, a moc-toe style boot 10 according to the present disclosure is described in further detail below. The boot 10 in the depicted embodiment is what is commonly referred to as a moc-toe style boot, where the term "moc" is short for the term "moccasin".

As noted previously, a moc-toe boot generally and commonly refers to a type of leather work boot with a "U" shaped stitched toe box. The "U" shaped stitched toe box provides increased comfort, extra flexibility, and toe protection while working. The shape of the moc-toe, with the higher walls in the toe box, offers more room for the wearer's toes, offering extra comfort.

In most conventional moc-toe style boots, the seam on the top of the toe box is created by stitching together two pieces of material (e.g., leather) around the toe box. Although this construction gives the moc-toe boot its classic looks and provides added flexibility, the stitched seam and also the toe box in general may be a weak spot for moc-toe type boots, where the upper can start to separate from the lower toe wall due to heavy use. And, as discussed above, for certain types of moc-toe type boots that have an internal rigid toe protector (i.e., safety toe protector), a hard object such as the toe protector beneath the moc-toe area does not allow a lot of give or forgiveness, leading to possible tearing or blow-out of the exterior of the toe area.

The moc-toe style boot 10 shown in FIGS. 1-9 provides an improved design where the boot 10 includes a one-piece molded/pre-molded (e.g., polymeric) structure 12 forming at least a portion of the toe box construction 14. According to certain examples, the molded piece 12 may be formed from polymers such as TPU or similar polymers. Other polymers such as rubber may be suitable for the polymeric structure 12.

The one-piece molded structure 12 is designed to form both a lower toe wall 16 and the entire upper vamp portion 18 of the toe box 14, as will be discussed in further detail below. The pre-molded structure 12 provides a one-piece design, where the toe wall 16 and the upper vamp 18 are all molded as a single piece and where the upper portion of the molded piece 12 is designed to provide the entire vamp area 18 of the boot 10.

According to preferred embodiments, the pre-molded polymeric structure 12 is designed to resemble the material used for the upper of the rest of the boot 10. According to certain embodiments, the upper of the boot 10 may be of organic leather construction (or of other materials as will be discussed below). The pre-molded structure 12 may be provided with stitching 74 designed to resemble the way conventional materials such as leather pieces would be stitched in forming the seam of the toe box 14 to preserve the classic looks of the moc-toe design.

According to certain embodiments, the polymer defining the pre-molded structure 12 may be provided with surface-texturing 24 and dyed to resemble conventional materials used for moc-toe type boots such as organic leather.

The one-piece molded structure 12 is designed to greatly improve the durability of the area that is commonly associated with the stitched seam, while preserving the classic looks of the "U" shaped stitched toe box.

Although the principles of the present disclosure are described herein with respect to moc-toe style boots, it will be understood that the inventive aspects may be applicable to other types of boots or general footwear.

FIG. 1 of the present disclosure illustrates a partial front perspective view of the boot 10 including the inventive durable moc-toe construction. And, FIG. 2 illustrates a close-up view of the region of the boot 10 of FIG. 1, where the vamp portion 18 defined by the one-piece molded structure 12 forming the durable moc-toe construction is stitched to the rest of an upper 26 around eyestays 28 of the boot 10, as will be described in further detail below.

Figure 2:
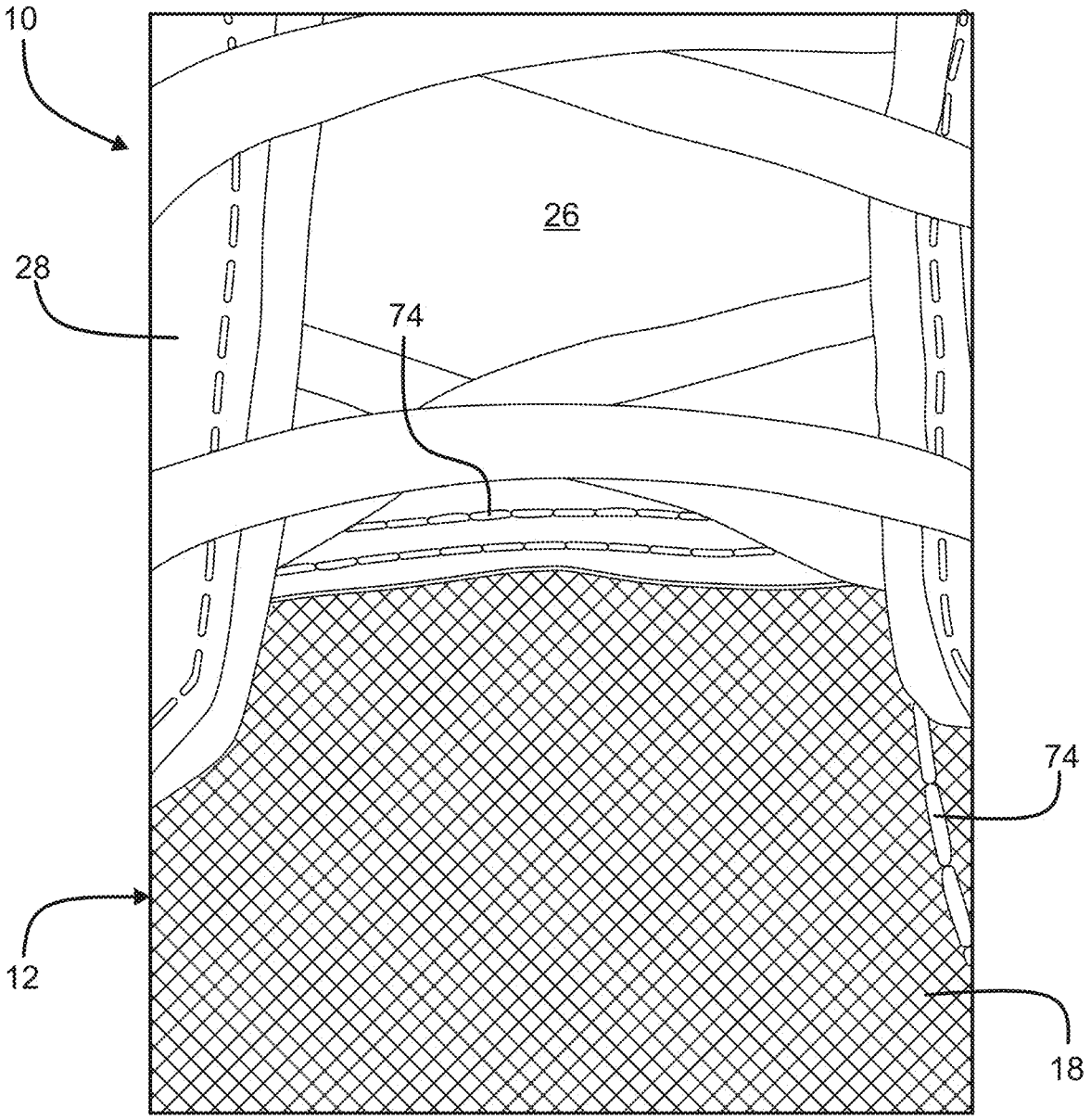
FIG. 2 illustrates a close-up view of the region of the boot of FIG. 1 where the vamp portion defined by the one-piece molded polymeric structure forming the durable moc-toe construction is stitched to the rest of the upper (e.g., leather) around the eyestays of the boot.
Figure 3:
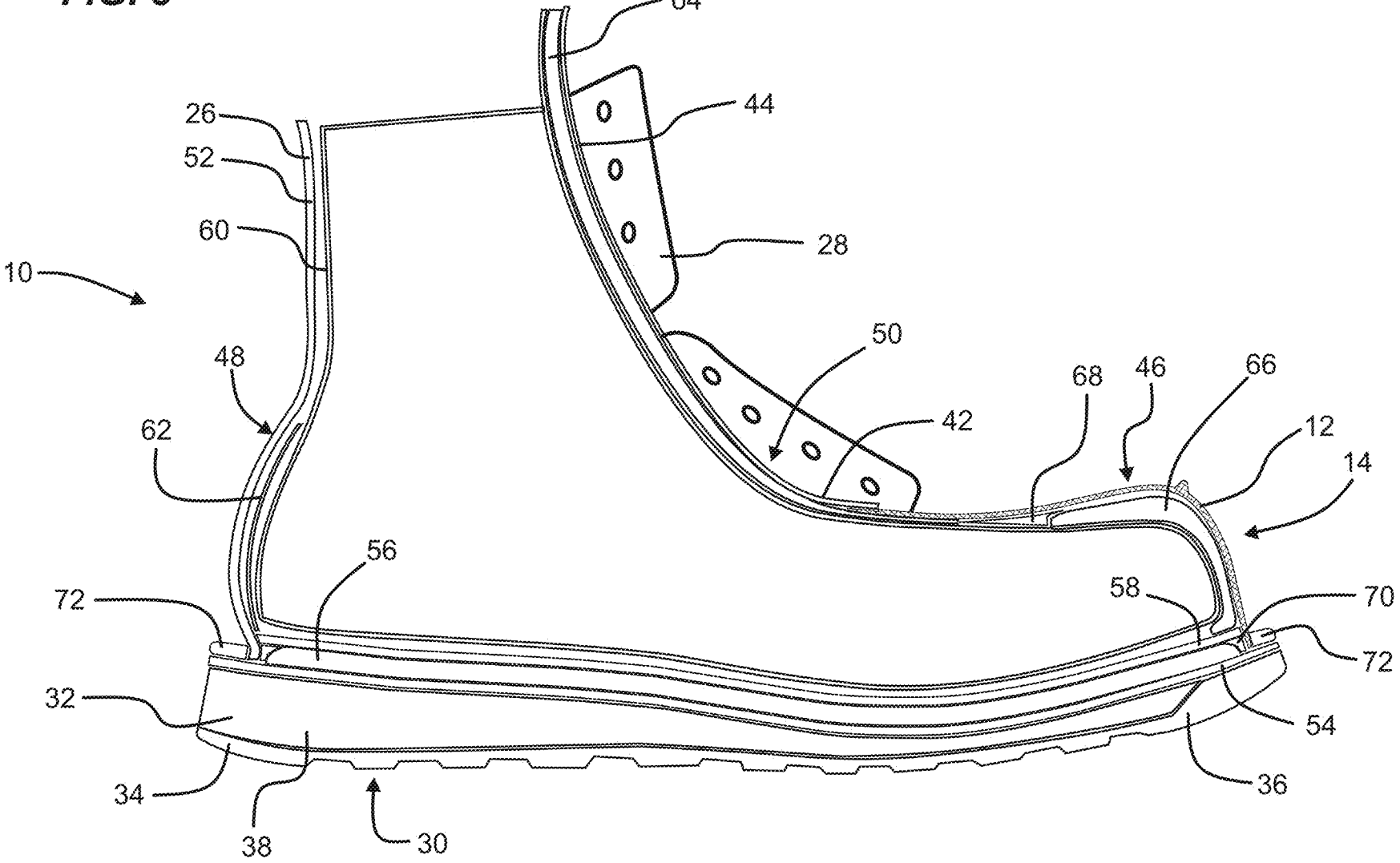
FIG. 3 is a cross-sectional view taken along a line bisecting the boot of FIGS. 1 and 2 including the inventive durable moc-toe construction according to the principles of the present disclosure, the cross-sectional view illustrating the different layers of the boot.

FIG. 3 illustrates a cross-sectional view along a line bisecting the boot 10 of FIGS. 1 and 2 including the inventive durable moc-toe construction according to the principles of the present disclosure. The cross-sectional view of FIG. 3 illustrates the different layers of the boot 10.

Referring now specifically to FIG. 3, in the depicted embodiment of the boot 10, the boot 10 includes a sole 30 formed from a midsole 32 and an outsole 34. An upper 26 (majority of which may be constructed of organic leather according to one example embodiment) is connected to the sole 30. As noted above, even though organic leather is used for most moc-toe type boots and is contemplated as an example material for the upper 26 of the present inventive boot 10, it should be appreciated that in alternative embodiments, the boot upper 26 may be constructed of materials other than organic leather (e.g., textiles such as Cordura re/corTM fabrics, synthetic materials, etc.)

In the depicted embodiment, the sole 30 generally includes a forefoot portion 36 and a heel portion 38. In the depicted embodiment, the moc-toe boot 10 generally has a welt construction 72 (e.g., a leather welt) for securing the upper 26 to the sole 30. It should be appreciated that many other alternative sole 30 and upper 26 configurations are possible. For example, the boot 10 can have a flat sole 30 that is glued to the upper 26 instead of stitched to the upper 26. Numerous other configurations are also possible.

In the depicted embodiment, the upper 26 includes a foot covering portion 42 that is connected to the sole 30 and a lower leg covering portion 44 located above the foot covering portion 42. In the depicted embodiment, the foot covering portion 42 includes a toe covering portion 46, a heel covering portion 48, and an instep covering portion 50. In the depicted embodiment, the foot covering portion 42 includes the eyestays (e.g., leather) 28. The leg covering portion 44 is shown as part of a short boot shaft 52 of the boot 10.

In the depicted embodiment, a majority of the foot covering portion 42 may have a leather (or other material as discussed above) construction 51. However, as noted above, the boot 10 includes a one-piece molded/pre-molded (e.g., polymeric) structure 12 forming at least a portion of the toe box construction 14. According to the depicted embodiment, the one-piece molded structure 12 is designed to form both the lower toe wall 16 and the entirety of the upper vamp portion 18 of the toe box 14, where the portion of the molded structure 12 forming the vamp portion 18 extends to at least the eyestays 28 of the upper 26, as shown in FIGS. 1-3. As discussed above, according to one example, the one-piece structure 12 may be formed from TPU.

Still referring to the layers associated with the inventive moc-toe boot 10 of FIG. 3, a doubler layer 54 is provided between a filler layer 56 and the sole 30. The filler layer 56 is provided between the doubler layer 54 and an insole board 58. As shown, a lining/bootie 60 is provided internally and separated from the upper 26 at the heel covering portion 48 by a heel counter 62. The lining 60 is separated from the upper 26 at the instep covering portion 50 by foam padding 64 that extends all the way up the boot shaft 52. As shown, at least a portion of the foam padding 64 extends forwardly to be positioned between the lining 60 and the portion of the polymeric molded structure 12 that forms the vamp 18 of the boot 10. In the depicted embodiment, at the toe-covering portion 46, the lining 60 is also separated from the molded structure 12 forming the toe box 14 by a safety toe guard 66 and an x-ray strip 68 positioned between the toe guard 66 and the foam padding 64.

As will be described with respect to FIG. 4, a plyrib 70 is used in combination with the leather welt 72 to stitch both the upper 26 to the sole 30 and the polymeric molded structure 12 forming the toe box construction 14 to the sole 30.

Figure 4:
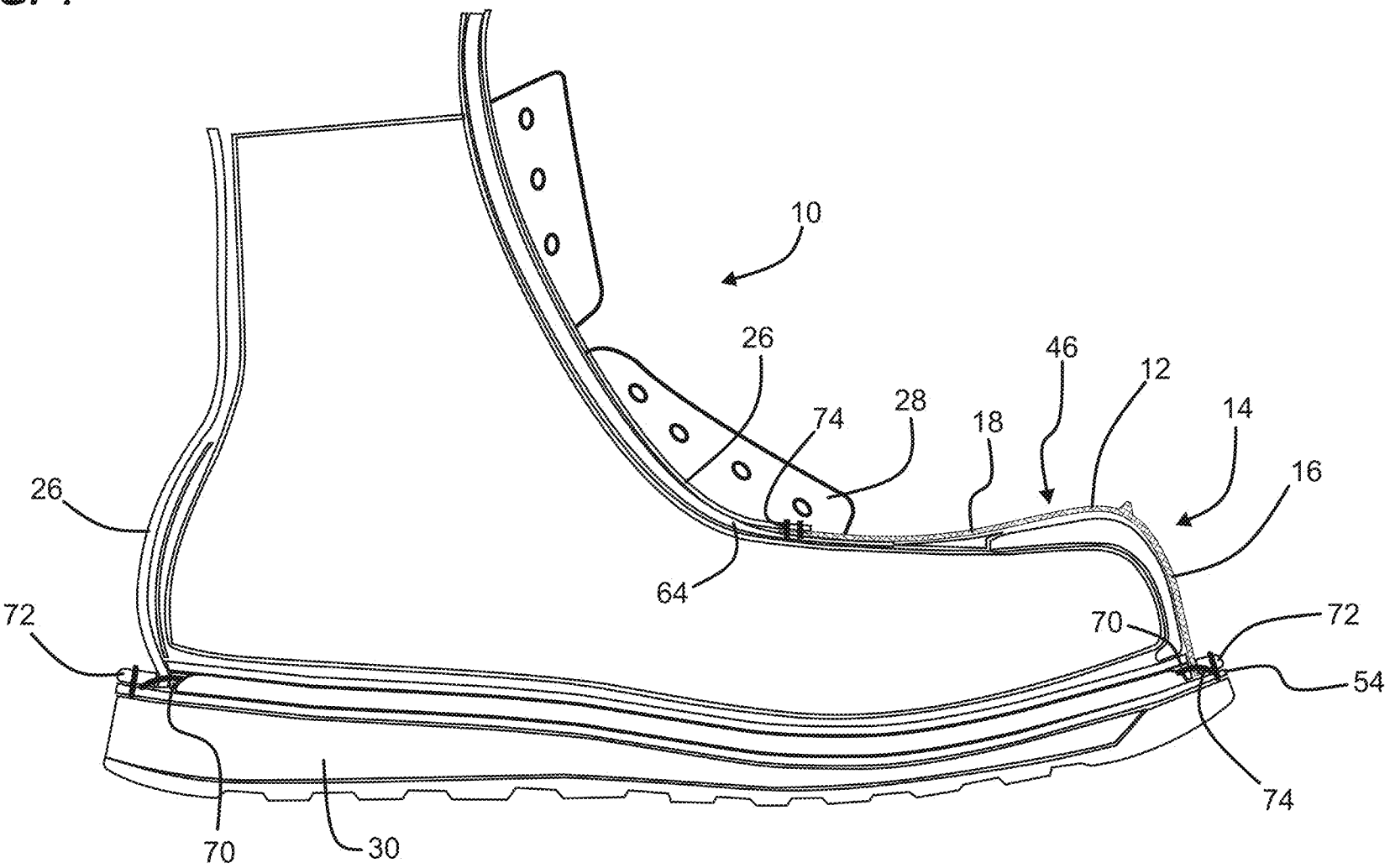
FIG. 4 is another cross-sectional view taken along a line bisecting the boot of FIGS. 1 and 2, illustrating the stitching used for the durable moc-toe construction of the boot.

Referring now specifically to FIG. 4, as depicted, the lower toe wall portion 16 of the one-piece molded structure 12 is stitched to the plyrib 70 as the leather welt 72 is stitched to the doubler 54, similar to conventional stitching methods used for leather constructed moc-toe type boots. As further shown, the upper vamp portion 18 defined by the one-piece molded structure 12 is stitched to and captured between the upper 26 (e.g., leather) and the foam padding 64, generally around the area of the leather eyestays 28 (as shown in the views of FIGS. 1 and 2).

Figure 5:
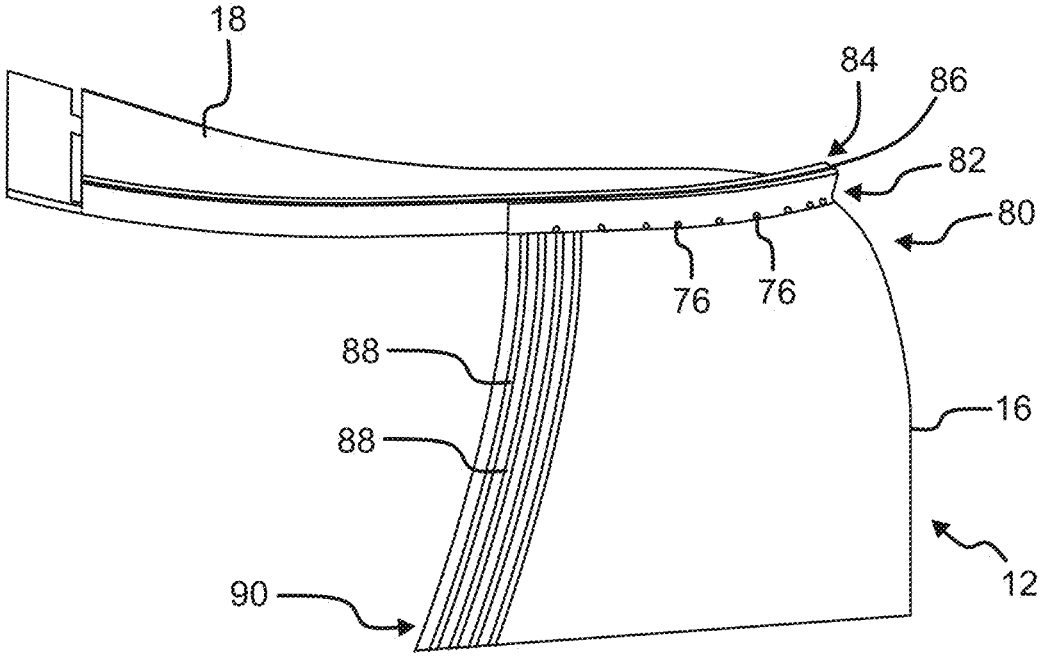
FIG. 5 is a lateral view of the one-piece molded polymeric structure forming the durable moc-toe construction of the boot of FIGS. 1-4, the one-piece molded polymeric structure shown in isolation separated from the boot.
Figure 6:
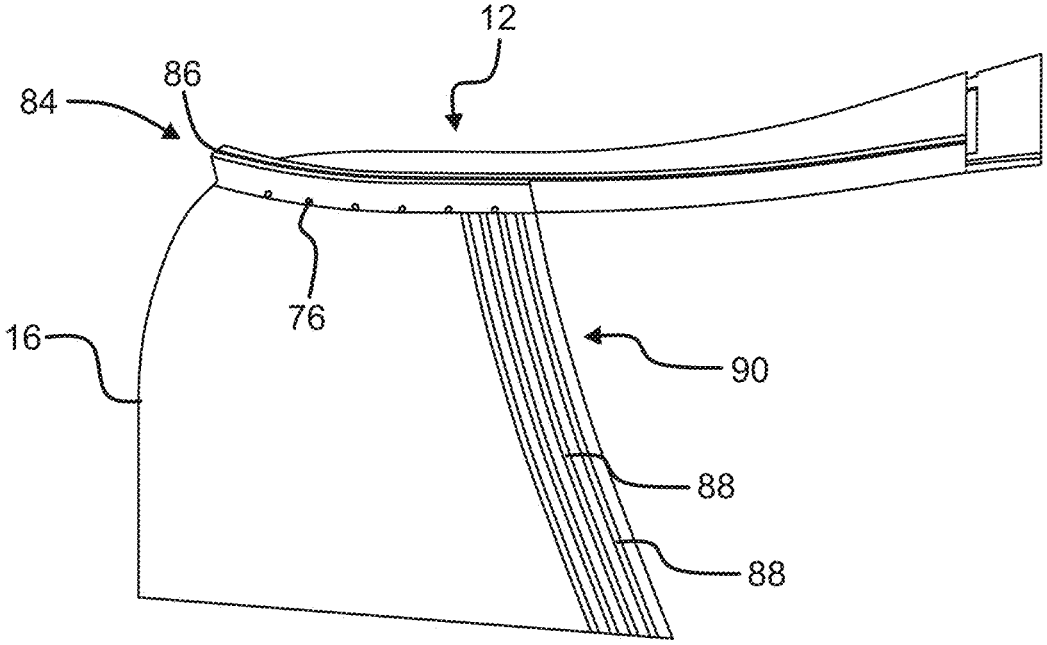
FIG. 6 is a medial view of the one-piece molded polymeric structure of FIG. 5.
Figure 8:
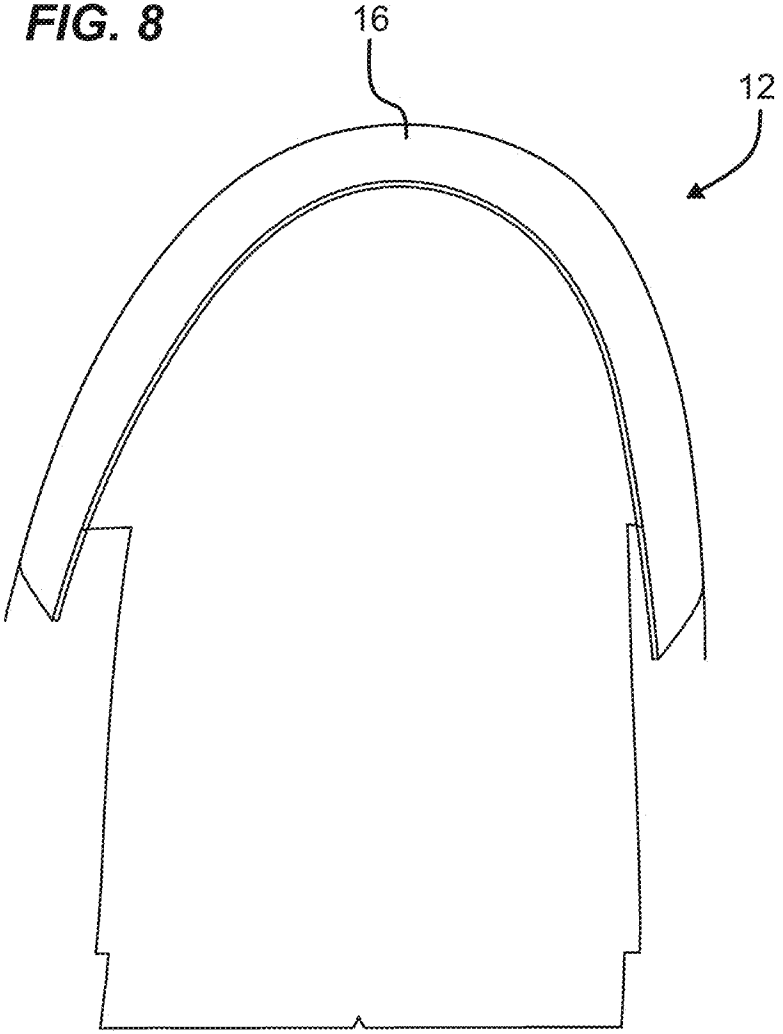
FIG. 8 is a bottom view of the one-piece molded polymeric structure of FIG. 5.
Figure 7:
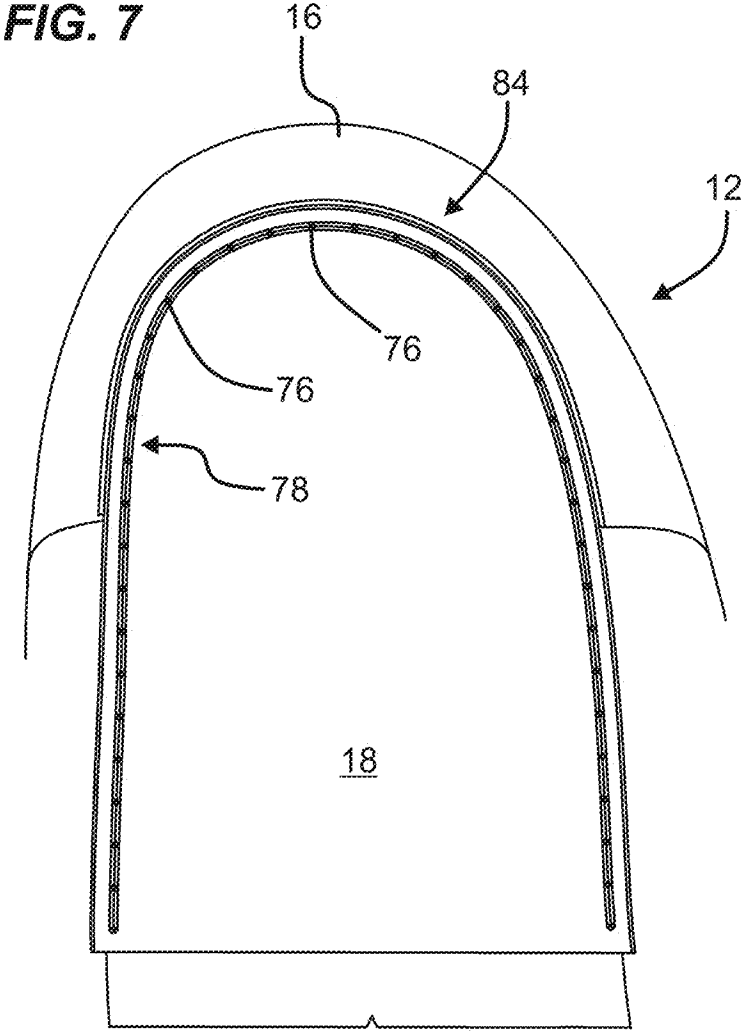
FIG. 7 is a top view of the one-piece molded polymeric structure of FIG. 5.
Figure 9:
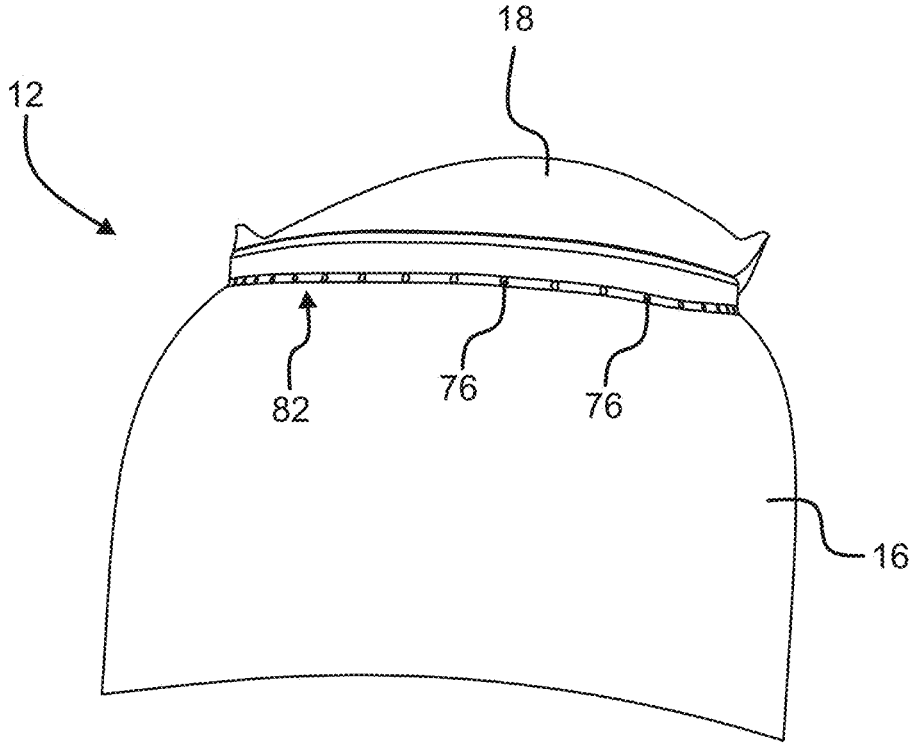
FIG. 9 is front view of the one-piece molded polymeric structure of FIG. 5.

Referring now to FIGS. 5-9, various views of the one-piece molded structure 12 forming the durable moc-toe construction of the boot 10 of FIGS. 1-4 is shown in isolation separated from the boot 10. FIG. 5 illustrates a lateral view of the molded structure 12. FIG. 6 is a medial view of the one-piece molded structure 12. FIG. 7 is a top view of the one-piece molded structure 12, and FIG. 8 is a bottom view of the one-piece molded structure 12. FIG. 9 illustrates the one-piece molded structure 12 from the front.

As shown, the molded structure 12 defines the front vertical toe walls 16 of the toe covering portion 46 of the boot 10. The portion of the molded structure 12 that forms the upper vamp 18 of the instep covering portion 50 extends back from the toe wall portion 16. As noted above, the portion forming the upper vamp 18 that extends past the vertical toe walls 16 is configured for being stitched to the remainder of the upper 26 of the boot 10 as shown in FIGS. 1 and 2 and as illustrated in the cross-sectional views of FIGS. 3 and 4.

As noted above, the pre-molded structure 12 may be designed to resemble leather construction (or other types of materials used for the upper 26). The pre-molded structure 12 may be provided with stitching 74 designed to resemble the way, for example, leather pieces would be stitched in forming the seam of the toe box 14 to preserve the classic looks of the moc-toe design.

According to certain embodiments, the pre-molded structure 12 may be surface-textured and dyed to resemble, for example, organic leather.

As shown in FIGS. 5-9, the one-piece molded structure 12 defines pre-molded holes 76 both around generally an entire upper periphery 78 of the part forming the vamp portion 18 and at a front 80 of the structure 12 at an upper part 82 of the toe wall 16. It should be noted that the molded one-piece structure 12 is molded with a faux edge feature 84 that provides a slight notch or separation 86 of the lower toe wall 16 and the upper vamp portion 18. The faux edge 84 created by the molded notch 86 gives the appearance of a classic two-piece leather construction, especially when combined with the stitching 74 provided within the pre-molded holes 76.

As shown in FIGS. 5 and 6, the one-piece molded structure 12 also defines pre-molded vertical stitch lines 88 for stitching a back 90 of the toe wall 16 to the leather upper 26 of the boot 10. The stitching 74 of the back area 90 of the toe wall 16 of the molded structure 12 to the upper 26 of the boot 10 is shown in FIG. 1.

As also shown in FIG. 1, the faux edge 84 is designed to transition into a physical edge 92 between the portion of the molded structure 12 that defines the upper vamp portion 18 and leather sidewalls 94 of the upper 26 of the boot 10 that are positioned past the vertical stitch lines 88. The portion of the molded structure 12 that defines the upper vamp 18 is stitched to leather sidewalls 94 of the boot 10 past the vertical stitches 74, as shown in FIG. 1. In this manner, the molded structure 12 is integrated into the moc-toe style boot 10 by being stitched to the remainder of the leather upper 26 as in conventional moc-toe style boots, preserving the classic looks of the boot 10.

The description and illustration of one or more embodiments or materials provided in this application are not intended to limit or restrict the scope of the inventive aspects as claimed in any way. The embodiments, examples, materials, and other details provided in this application are considered sufficient to convey possession and enable others to make and use the best mode of the claimed inventive aspects. The claimed inventive aspects should not be construed as being limited to any embodiment, example, material, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed inventive aspects and the general inventive concept embodied in this application that do not depart from the broader scope.

What is claimed is:

1. A moc-toe style boot comprising:

a sole; and an upper, the upper including a foot covering portion connected to the sole and a lower leg covering portion located above the foot covering portion, wherein the foot covering portion includes a toe covering portion, a heel covering portion, and an instep covering portion, wherein a majority of the foot covering portion of the upper of the boot is formed of leather construction, the foot covering portion defining at least a portion having a one-piece molded polymeric construction, wherein the one-piece molded polymeric construction defines a generally vertically molded toe wall of the toe covering portion and a generally horizontally molded upper vamp of the instep covering portion that extends to at least eyestays defined by the upper of the boot, wherein the vertical toe wall portion of the one-piece molded polymeric construction is generally rigidly molded relative to the horizontal upper vamp portion thereof so as to extend down from and be generally normal to the upper vamp portion of the one-piece molded polymeric construction, wherein the upper vamp defined by the one-piece molded polymeric construction is stitched to a portion of the upper of the boot that is formed of leather construction around the eyestays, wherein the one-piece molded polymeric construction defines a faux edge formed by a visible notch between the vertical toe wall and at least a portion defining the upper vamp, wherein the one-piece molded polymeric construction defines pre-molded stitch openings both around generally an entire front periphery of the upper vamp and of an upper part of the vertical toe wall, wherein stitching is provided at the pre-molded stitch openings, wherein the one-piece molded polymeric construction also defines pre-molded vertical stitch lines at a rear part of the vertical toe wall such that stitching is provided at the pre-molded vertical stitch lines for stitching the vertical toe wall defined by the one-piece molded polymeric construction to leather sidewalls of the rest of the foot covering portion that are positioned behind the vertical toe wall, wherein the faux edge is designed to transition into a physical edge that is formed between the portion of the one-piece molded polymeric construction that defines the upper vamp and the leather sidewalls positioned past the vertical stitch lines in a front-to-back direction such that the portion of the one-piece molded polymeric construction that defines the upper vamp is also stitched to the leather sidewalls past the vertical stitch lines.

2. The boot of claim 1, wherein the one-piece molded polymeric construction is formed from TPU.

3. The boot of claim 1, wherein the one-piece molded polymeric construction defines surface texturing to resemble a material used for the construction of the upper of the boot.

4. The boot of claim 3, wherein a majority of the upper of the boot is of leather construction.

5. The boot of claim 1, wherein a majority of the upper of the boot is of leather construction.

6. The boot of claim 1, wherein the one-piece molded polymeric construction is dyed to visually resemble a material used for the construction of the rest of the upper of the boot.

7. The boot of claim 1, wherein the one-piece molded polymeric construction is dyed to visually resemble leather construction to match a leather construction of the rest of the boot.

* * * * *